US006173953B1

(12) United States Patent
Leibman

(10) Patent No.: US 6,173,953 B1
(45) Date of Patent: Jan. 16, 2001

(54) SIMPLE PAPER INDEXER

(75) Inventor: Bernard Leibman, Webster, NY (US)

(73) Assignee: Xerox Corporation, Stamford, CT (US)

( * ) Notice: Under 35 U.S.C. 154(b), the term of this patent shall be extended for 0 days.

(21) Appl. No.: 09/316,218

(22) Filed: May 21, 1999

(51) Int. Cl.[7] ..... B65H 5/12
(52) U.S. Cl. ..... 271/266; 271/267
(58) Field of Search ..... 271/264, 266, 271/188, 193, 84, 267; 226/8, 158, 159, 167, 162, 200

(56) References Cited

U.S. PATENT DOCUMENTS

| | | | | |
|---|---|---|---|---|
| 3,276,774 | * | 10/1966 | Hunter | 271/266 |
| 3,612,373 | * | 10/1971 | Hermann | 226/167 |
| 3,747,921 | * | 7/1973 | Knappe | 271/266 |
| 3,929,328 | * | 12/1975 | Knappe et al. | 271/267 |
| 4,012,034 | | 3/1977 | Nelson | 271/173 |
| 4,012,035 | | 3/1977 | Nelson | 271/173 |
| 4,071,233 | * | 1/1978 | Morton | 271/264 |
| 4,111,410 | | 9/1978 | Tates et al. | 271/173 |
| 4,116,429 | | 9/1978 | VanBuskirk | 271/173 |
| 4,124,204 | | 11/1978 | VanBuskirk | 271/273 |
| 4,299,474 | | 11/1981 | Ernst et al. | 355/3 DR |
| 5,153,736 | | 10/1992 | Stemmle | 358/296 |
| 5,499,808 | * | 3/1996 | Nishimoto et al. | 271/267 |

OTHER PUBLICATIONS

Ehrenberg et al, Incremental Feed Mechanism, IBM Technical Disclosure Bulletin vol. 15 No. 7 pp. 2275–2276, Dec. 1972.*

Hall, Dot Resonant Frequency Adjustment Scheme IBM Technical Disclosure Bulletin vol. 18 No. 5 pp. 1665–1666, Oct. 1975.*

* cited by examiner

*Primary Examiner*—H. Grant Skaggs
(74) *Attorney, Agent, or Firm*—Andrew D. Ryan

(57) ABSTRACT

An indexing mechanism for advancing a substrate in a first direction is disclosed. The mechanism includes a guide for guiding the substrate along a substrate path and an urging member. The urging member is movable in a direction skewed with respect to the substrate path. The urging member cooperates with the guide to displace a portion of the substrate so that an end of the substrate advances in the first direction.

23 Claims, 3 Drawing Sheets

SIMPLE PAPER INDEXER

The present invention relates to a printing machine. More specifically, the invention relates to a device for advancing a substrate in a printing machine.

The features of the present invention are useful in the printing industry. One such type of machine is a printing machine, for example, an electrophotographic printing machine.

In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a marking material such as toner particles is transported into contact with the electrostatic latent image in a region known as the development zone. Toner particles are attracted from the magnetic roll to the latent image. The resultant toner powder image is then transferred from the photoconductive surface to a copy sheet and permanently affixed thereto. The foregoing generally describes a typical mono-color single component development electrophotographic copying machine.

Copying and printing machines utilize substrate typically in the form of paper to transfer the image copied or printed. The paper and other substrates are moved through the printing process such as the xerographic process and may be further moved along paper paths in one of several possible post processing devices. For example, the paper may be advanced through sorters, compilers, staplers, and binder.

Printing machines require mechanisms within the machine to advance the substrate or copy sheet through the xerographic process steps in order for the developed image may be transferred onto the copy sheet and fused thereto. Typically, the advancement of the copy sheets through the printing machine is accomplished through the use of a series of drive rolls which are positioned near chutes or parallel guide surfaces between which the copy sheet is advanced. For each drive roll, a support or backup roll is positioned adjacent to a drive roll which forms a nip there between. The paper is positioned in the nip so that it may be thereby advanced along the paper path.

While in many applications papers are advanced along the paper path through the printing and copying machines through the use of feed drive rolls, in certain positions within the machine an indexing mechanism is used. The indexing mechanism may be quite complex and may be in the form of an electromechanical device. Such indexing devices include indexing motors and may include sensors and driver electronics to properly operate. These indexing mechanisms may be expensive and difficult, as well as, expensive to maintain. These indexing mechanisms may be designed to operate only one of two directions and may be difficult to reverse. These large complex expensive indexing mechanisms may be difficult to locate within a printing or copying machine where there are space restrictions. There may simply be no room for the motors and sensors involved. The present invention is directed toward solving at least some of the aforementioned problems.

The following disclosures may be relevant to various aspects of the present invention:

U.S. Pat. No. 5,153,736

Patentee: Stemmle

Issue Date: Oct. 6, 1992

U.S. Pat. No. 4,299,474

Patentee: Ernst, et al.

Issue Date: Nov. 10, 1981

U.S. Pat. No. 4,124,204

Patentee: VanBuskirk

Issue Date: Nov. 7, 1978

U.S. Pat. No. 4,116,429

Patentee: VanBuskirk

Issue Date: Sep. 26, 1978

U.S. Pat. No. 4,111,410

Patentee: Tates, et al.

Issue Date: Sep. 5, 1978

U.S. Pat. No. 4,012,035

Patentee: Nelson

Issue Date: Mar. 15, 1977

U.S. Pat. No. 4,012,034

Patentee: Nelson

Issue Date: Mar. 15, 1977

U.S. Pat. No. 5,153,736 discloses a scanner which has a frame assembly containing a carriage movably mounted in the frame assembly for scanning movement in a scanning path in a first direction along the length of the frame assembly from a home position to an end of scan position, the frame assembly including at least one sheet transport path including at least one index roll on a rotatable shaft to index a sheet through the path, the scanner further including a toggle frame supporting at one end at least one idler roll for forming a sheet transporting nip with at least one index roll and at the opposite end at least one sheet registration gate, the toggle frame being pivotally mounted to alternately provide a copy sheet transporting nip and a sheet registration gate in said sheet transport path, the frame being activated to provide a registration gate in the sheet transport path by the scanning carriage when it is adjacent to or at the home position.

U.S. Pat. No. 4,299,474 discloses electrical components in an elongated array which are suspended within the interior of a sleeve type closed loop member such as a rotatable photoconductor drum or closed loop belt of a compact copier. Preferably some of the components are mounted on a board and held within the sleeve by edge slots or the like in sleeve mounting end caps, attached to the machine frame. A drive motor can be attached as part of the array and further can be arranged to drive a fan blade so that cooling air is forced through the sleeve and over the components so that the sleeve acts as a plenum. Power can be coupled from the drive motor through the end mounts to motivate the sleeve in the direction of its closed loop and/or apply power to other components of the copier.

U.S. Pat. No. 4,124,204 discloses an improved sorting apparatus and reproducing machine are provided with a plurality of sheet receiving bins. A first frame supports the bins. A sheet transport is arranged in a second frame. The frames are supported for relative movement between a first closed position wherein the sheet transport is operatively associated with the bins and a second open position wherein access is provided to the transport and bins for sheet clearance. The sheet transport includes at least one belt which is operatively maintained under a desired tension. A device is provided for reducing the belt tension in response to the relative movement of the frames between their respective closed and open positions. In accordance with another feature a counterbalance is provided for counterbalancing the frame supporting the transport as it moves away from the frame supporting the bins. The counterbalance comprises at least one cantilever spring mounted to the bin frame and a roller type device mounted to the transport frame which engages the cantilever spring.

U.S. Pat. No. 4,116,429 discloses a sorting apparatus and reproducing machine comprising a plurality of sheet receiving bins supported in a first frame. A sheet transport is supported in a second frame. The frames are arranged for relative movement between a first closed position wherein the transport is operatively associated with the bins and a second open position to provide access to the transport and the bins for sheet clearance. The second frame supports a guide member for guiding a sheet along the transport. The guide member is supported for movement between a first position wherein it is spaced closely adjacent to the transport and a second position wherein it is more widely spaced therefrom. A cam and follower arrangement is utilized to move the guide member between its respective first and second positions in response to the opening and closing of the frames.

U.S. Pat. No. 4,111,410 discloses a sorting apparatus for collating the output of a reproducing machine comprises a plurality of sheet receiving bins arranged in a row. The bin spacing for the first and last bins is greater than that for intermediate bins. The narrow spaced intermediate bins are articulated to allow their bin entrance openings to be increased as a sheet is fed into them. Individual deflection gates are associated with each of the bins. The deflection gate for the first bin is actuated by means of a solenoid whereas the deflection gates for the remaining bins are actuated by a coordinated cam bank.

U.S. Pat. No. 4,012,035 discloses an improved sorter control system for controlling modular sorting assemblies which receive copy sheets from a duplicating machine and distribute the sheets into bins to form collated sets of document information being reproduced. The control system uses two cam operated switches in conjunction with two contacts of a relay which change state as a sheet of paper interrupts a light beam in each of the modular sorter assemblies. In this manner both the lead edge and the trail edge of a copy sheet break the light beam upon entering a bin causing an index mechanism which controls the sequence of opening the gates for each of the bins to advance. The gate last opened directs copy sheets to the next modular sorting assembly to continue the sorting operation in an expeditious manner.

U.S. Pat. No. 4,012,034 discloses an improved sorter control system for controlling modular sorting assemblies which receive copy sheets from a duplicating machine and distribute the sheets into bins to form collated sets of document information being reproduced. The control system uses two states of a cam operated switch in conjunction with two contacts of a relay which changes state as a sheet of paper interrupts a light beam in each of the modular sorter assemblies. In this manner both the lead edge and the trail edge of a copy sheet breaking and clearing, respectively, the light beam upon entering a bin are recognized causing an index mechanism which controls the sequence of opening the gates for each of the bins to advance. The gate last opened directs copy sheets to the next modular sorting assembly to continue the sorting operation.

In accordance with one aspect of the present invention, there is provided an indexing mechanism for advancing a substrate in a first direction. The mechanism includes a guide for guiding the substrate along a substrate path and an urging member. The urging member is movable in a direction skewed with respect to the substrate path. The urging member cooperates with the guide to displace a portion of the substrate so that an end of the substrate advances in the first direction.

In accordance with another aspect of the present invention, there is provided a printing machine of the type having an indexing mechanism for advancing a substrate in a first direction. The mechanism includes a guide for guiding the substrate along a substrate path and an urging member. The urging member is movable in a direction skewed with respect to the substrate path. The urging member cooperates with the guide to displace a portion of the substrate so that an end of the substrate advances in the first direction.

In accordance with a further aspect of the present invention, there is provided a method of advancing a substrate in a printing machine. The method includes the steps of guiding the substrate along a substrate path in a first direction, advancing a member toward the substrate in a direction skewed with respect to the substrate path, positioning the substrate between the member and a guide, and displacing a portion of the substrate in a direction normal to the direction of the substrate path so that an end of the substrate advances in a first direction along the substrate path.

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
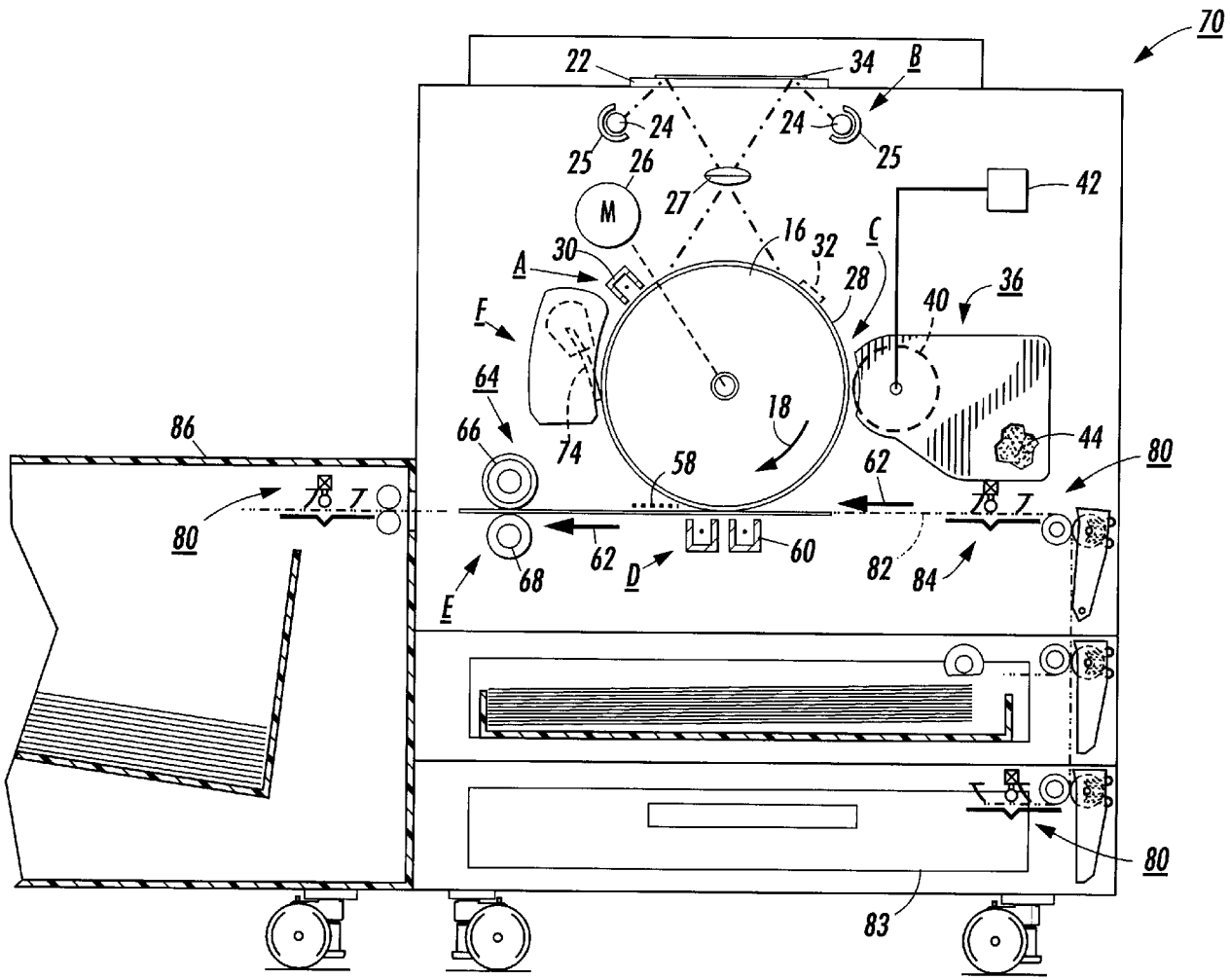
FIG. 3 is a schematic elevational view of an electrophotographic printing machine incorporating the FIG. 1 indexing mechanism therein.

For a general understanding of the illustrative electrophotographic printing machine incorporating the features of the present invention therein, reference is made to the drawings. In the drawings, like reference numerals have been used throughout to designate identical elements. FIG. 3 schematically depicts the various components of an electrophotographic printing machine incorporating the integral biasing feature of the present invention therein. Although the integral biasing feature of the present invention is particularly well adapted for use in the illustrative printing machine, it will become evident that the integral biasing feature is equally well suited for use in a wide variety of printing machines and are not necessarily limited in its application to the particular embodiment shown herein.

Referring now to FIG. 3, the electrophotographic printing machine shown employs a photoconductive drum 16, although photoreceptors in the form of a belt are also known, and may be substituted therefor. The drum 16 has a photoconductive surface 28 deposited on a conductive substrate. Drum 16 moves in the direction of arrow 18 to advance successive portions thereof sequentially through the various processing stations disposed about the path of movement thereof. Motor (M) 26 rotates drum 16 to advance drum 16 in the direction of arrow 18. Drum 16 is coupled to motor 26 by suitable means such as a drive.

Initially successive portions of drum 16 pass through charging station A. At charging station A, a corona generating device, indicated generally by the reference numeral 30, charges the drum 16 to a selectively high uniform electrical potential, preferably negative. Any suitable control, well known in the art, may be employed for controlling the corona generating device 30.

A document 34 to be reproduced is placed on a platen 22, located at imaging station B, where it is illuminated in known manner by a light source such as a tungsten halogen lamp 24. The document thus exposed is imaged onto the drum 16 by a system of mirrors 25 and lens 27, as shown. The optical image selectively discharges the surface 28 of the drum 16 in an image configuration whereby an electrostatic latent image 32 of the original document is recorded on the drum 16 at the imaging station B.

It should be appreciated that the printing machine may be a digital printing machine. In a digital printing machine a ROS (Raster Optical Scanner) may lay out the image in a series of horizontal scan lines with each line having a specific number of pixels per inch. The ROS may include a laser (not shown) having a rotating polygon mirror block associated therewith. The ROS exposes the photoconductive surface of the printer.

At development station C, a magnetic development system or unit, indicated generally by the reference numeral 36 advances developer materials into contact with the electrostatic latent images. Preferably, the magnetic developer unit includes a magnetic developer roller mounted in a housing. Thus, developer unit 36 contains a magnetic roller 40. The roller 40 advances toner particles into contact with the latent image. Appropriate developer biasing is may be accomplished via power supply 42, electrically connected to developer unit 36.

The developer unit 36 develops the charged image areas of the photoconductive surface. This developer unit contains magnetic black toner, for example, particles 44 which are charged by the electrostatic field existing between the photoconductive surface and the electrically biased developer roll in the developer unit. Power supply 42 electrically biases the magnetic roll 40.

A sheet of support material 58 is moved into contact with the toner image at transfer station D. The sheet of support material is advanced to transfer station D by a suitable sheet feeding apparatus, not shown. Preferably, the sheet feeding apparatus includes a feed roll contacting the uppermost sheet of a stack copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, stapling, binding, inverting and returning the sheet for duplexing and the like.

After the sheet of support material is separated from the photoconductive surface of drum 16, the residual toner particles carried by image and the non-image areas on the photoconductive surface are charged to a suitable polarity and level by a preclean charging device (not shown) to enable removal therefrom. These particles are removed at cleaning station F. A cleaner unit is disposed at the cleaner station F. The cleaner unit has a blade 74 that scrapes the residual toner particles from the drum 16 and then the particles are deposited into a waste container. Subsequent to cleaning, a discharge lamp or corona generating device (not shown) dissipates any residual electrostatic charge remaining prior to the charging thereof for the next successive imaging cycle.

It is believed that the foregoing description is sufficient for purposes of the present application to illustrate the general operation of an electrophotographic printing machine incorporating the apparatus of the present invention therein.

Referring again to FIG. 3, an indexing mechanism 80 is shown installed in the printing machine 70. The indexing mechanism 80 is used to advance a sheet or substrate 58 along a paper path 82. The indexing mechanism 80 may be placed anywhere within the printing machine where copy sheet 58 requires advancement. For example, as is shown in FIG. 3, the indexing mechanism 80 may be positioned adjacent feed tray 83, along the main feed path prior to the xerographic operations at position 84 or placed within a post processor 86.

Figure 1:
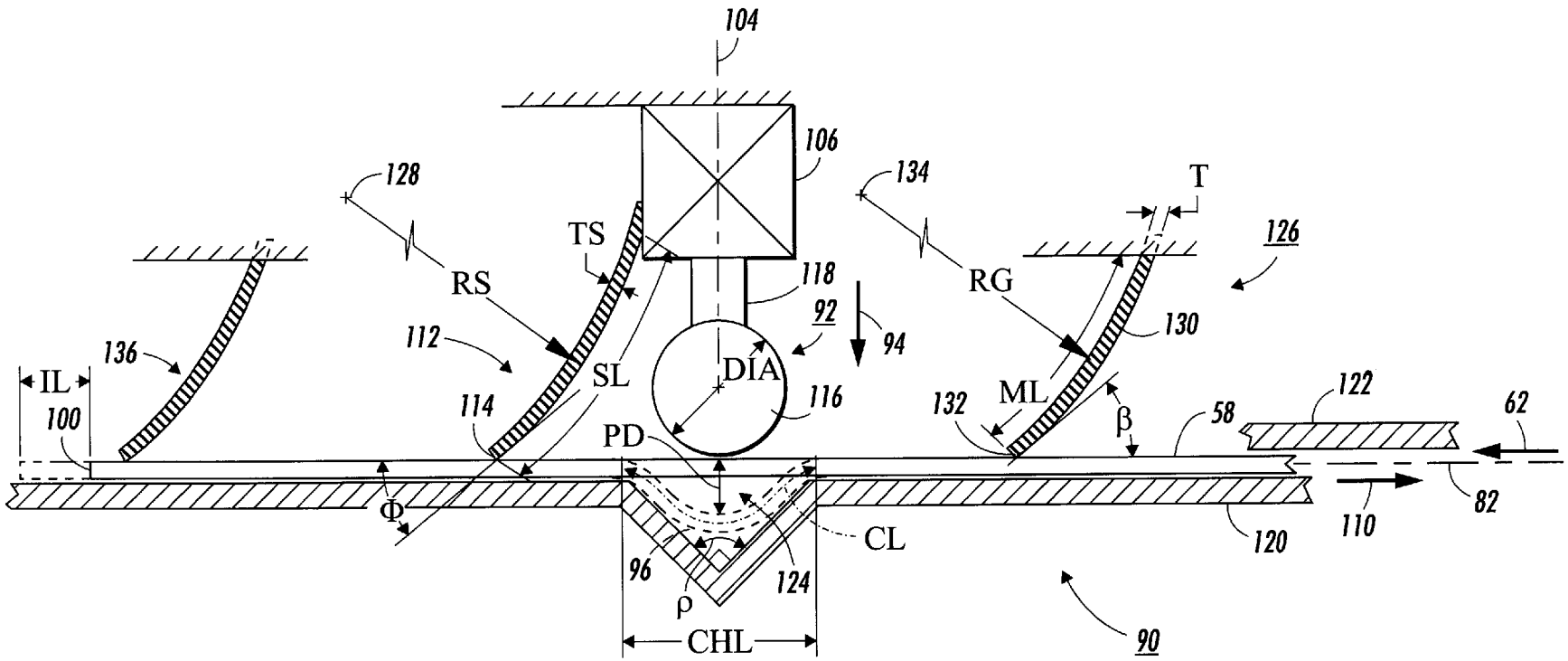
FIG. 1 is a plan view of an indexing mechanism utilizing the substrate memory feature according to the present invention showing the plunger spaced from the substrate.

Referring now to FIG. 1, the indexing mechanism 80 is shown in greater detail. The indexing mechanism 80 is utilized for advancing the substrate or paper 58 in the first direction 62. The indexing mechanism 80 includes a guide 90 for guiding the paper 58 along the paper path 82. The indexing mechanism 80 further includes a urging member 92. The urging member is movable in a direction 94 which is skewed with respect to the paper path 82. The urging member 92 cooperates with the guide 90 to displace a portion 96 of the paper 58 so that an end or leading edge 100 of the paper 58 advances in the first direction 62.

As shown in FIG. 1, the urging member 92 moves in the direction 94 along axis 104. Axis 104 forms an angle $\alpha$ with the guide 90. While it should be appreciated that the urging member 92 may be used with an angle α which is, i.e. less than 180° and greater 0°. Preferably, to minimize the motion of the plunger, the urging member 92 is oriented such that it moves along direction 94 and axis 104 at an angle α of 90°. Thus, the urging member 92 is preferably movable in a direction substantially perpendicular to the paper path 82.

Preferably, and is shown in FIG. 1, the indexing mechanism 80 also includes a mechanism 106 for cyclically moving the urging member 92 along axis 104. The mechanism 106 may be any device capable of cyclically moving the urging member 92 and may, for example, include a solenoid or pulsing device. For example, the mechanism 106 may be a solenoid provided by Lucas Corporation.

Preferably, the indexing mechanism 80 also includes a stop 112 for permitting motion in the first direction 62 and prohibiting motion in a second direction 110 opposed to the first direction 62. The stop 112, for simplicity, may be secured to the urging member 92 and movable with the urging member 92. It should be appreciated, however, that the stop 112 may be separately mounted and may be fixedly positioned within the paper path 82.

As shown in FIG. 1, the stop includes a free end 114 of the stop 112. The free end 114 is contactable with the paper 58 and is utilized to position the paper 58 between the free end 114 of the stop 112 and the guide 90. The stop 112 is adapted to permit motion in the first direction 62 and to prohibit motion in the second direction 110 opposed to the first direction 62. The stop 112 is preferably made of a resilient material for example, a synthetic rubber such as Neoprene.

Preferably, and as shown in FIG. 1, the stop 112 forms an acute angle Φ with the guide 90 and consequently with the sheet 58 by forming an acute angle Φ between the stop 112 and the paper 58. The paper 58 may deflect the stop 112 away from the guide 90 to permit motion of the paper 58 in the first direction 62. Preferably, further and as shown in FIG. 1, the stop 112 further is generally arcuate having a arcuate radius RS having a center 128 located in the first direction 62 from the stop 112. The radius RS and the angle Φ serve to permit easy motion of the substrate 58 in the first direction 62. Conversely, the angle Φ and the radius RS serve to strengthen the stop 112 when the sheet 58 is attempted to be moved in the second direction 110. Thus, the stop 112 serves to prohibit motion in the second direction 110.

It should be appreciated that the proper dimensions for the stop 112 depend on the particular application and the material and dimensions of the stop 112. For example, however, applicants have found that for a stop 112 made of a resilient rubber and having a thickness TS of approximately 0.2 inches and a length SL of approximately I inches and an arcuate angle Φ of approximately 40° and a radius length RS of approximately 1 inch is sufficient for proper operation of the stop 112.

The urging member 92 may be made of any suitable durable material and may have any shape capable of displacing paper 58. For example, and as shown in FIG. 1, the urging member 92 may be in the form of plunger. The plunger 92 may have any suitable shape and may, as shown in FIG. 1 for simplicity, include a portion 116 which has a arcuate or curved periphery. The plunger 92 cooperates with the guide 90 so as to position the paper 58 between the guide 90 and the portion 116 of the plunger 92 which includes the curved or arcuate surface.

The plunger 92 may have any suitable shape and, may for simplicity as shown in FIG. 1, include a spherical or ball-shaped portion 116 having a diameter, for example, DIA and a stem portion 118 connecting the spherical portion 116 to the mechanism 106. The plunger 92 may be made of any suitable material and may be made of, for example, a metal or a plastic. If made of plastic, the plunger 92 may be made of a polyamide, for example, Nylon.

The guide 90 may be any device capable of guiding the paper 58 along the paper path 82. For example, the guide 90 may be in the form of a planar surface or lower guide 120. To restrain and accurately guide the paper 58 along the paper path 82, the guide 90 may further include an upper guide 122 spaced from and generally parallel to the lower guide 120. The paper 58 is thus slidably fitted between the upper guide 122 and the lower guide 120.

Preferably, and as shown in FIG. 1, the guide 90 includes, for example, a cavity 124, which as shown in FIG. 1, is formed within the lower guide 120. The cavity 124 formed within the lower guide 120 may have any suitable shape. The cavity 124 cooperates with the urging member 92 to advance the paper 58 in the first direction 62. As shown in FIG. 1, the cavity 124 has a V-shape with an included angle ρ of, for example, 90°. It should be appreciated, however, that the cavity 124 may have other shapes including a generally spherically shape corresponding to the urging member 92.

The index mechanism 80 may further include a one-way gate 126 for permitting motion in the first direction 62 and for prohibiting motion in the second direction 110 opposed to the first direction 62. The one-way gate 126 may have any suitable configuration and may be in, for example, the form of a one-way ball clutch, or as shown in FIG. 1, be in the form of a flexible member or blade.

As shown in FIG. 1, the one-way clutch 126 includes a member 130 having a free edge 132 of the member 130 contactable with the sheet 58. The member 130 is utilized for positioning the paper 58 between the free end 132 of the member 132 and the lower guide 120. The member 130 is configured so as to permit motion in the first direction 62 and to prohibit motion in the second direction 110 opposed to the first direction 62. The member 130 is preferably made of a resilient material, for example, a synthetic rubber such as Neoprene.

Preferably, and as shown in FIG. 1, the member 130 forms an acute angle β with the lower guide 120 and consequently with the sheet 58 by forming an acute angle β between the member 130 and the paper 58. The paper 58 may deflect the member 130 away from the guide 120 to permit motion of the paper 58 in the first direction 62. Preferably, further and as shown in FIG. 1, the member 130 further is generally arcuate having a arcuate radius RG having a center 134 located in the first direction 62 from the member 130. The radius RG and the angle β serve to permit easy motion of the substrate 58 in the first direction 62. Conversely, the angle β and the radius RG serve to strengthen the member 130 when the sheet 58 is attempted to be moved in the second direction 110. Thus, the member 130 serves to prohibit motion in the second direction 110.

It should be appreciated that the proper dimensions for the member 130 depend on the particular application and the material and dimensions of the member 130. For example, however, applicants have found that for a member 130 made of a resilient rubber and having a thickness T of approximately 0.2 inches and a length ML of approximately I inch and an arcuate angle β of approximately 40° and a radius length RG of approximately 1 inch is sufficient for proper operation of the one-way gate 126.

The indexing mechanism 80 may further include a second one-way gate 136 which is similar to one-way gate 126.

While the first one-way gate 126 may be positioned upstream of the first direction 62 of the indexing mechanism 80, the second one-way gate 136 may be positioned downstream from the indexing mechanism 80.

Figure 2:
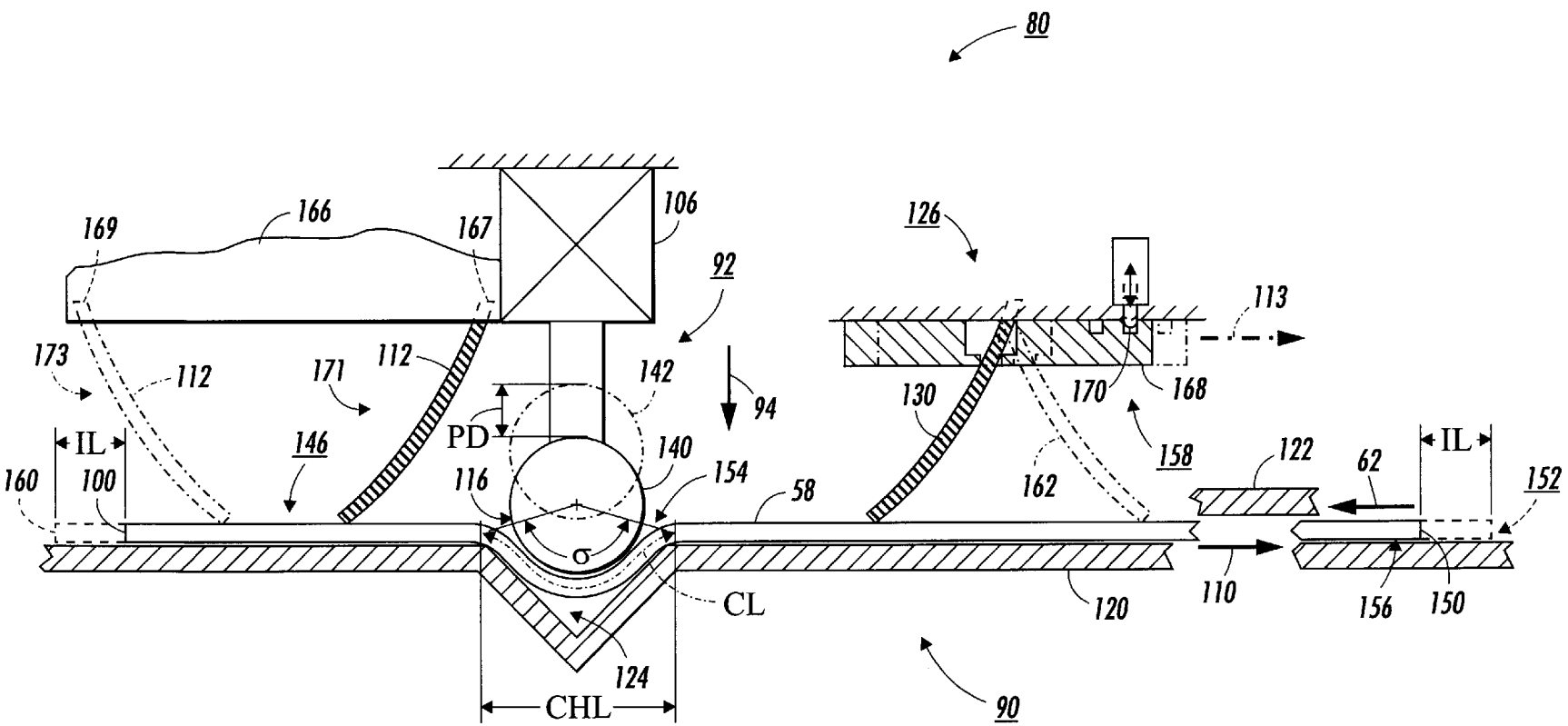
FIG. 2 is a plan view of the indexing mechanism of FIG. 1 showing the plunger in contact with the substrate.

Referring now to FIG. 2, the operation of the indexing mechanism 82 is shown located within the guide 90. A plunger 92 is shown in solid in its downward position 140 and its upward position in phantom 142. In the phantom position 142, the sheet 58 is positioned in a generally planar position with leading edge 100 of the sheet 58 in the first leading edge position 146 and trailing edge 150 in first trailing edge position 152. As shown in FIG. 2, the plunger 92 includes portion 116 of the plunger 92 which has a spherical shape governed by diameter DIA. The spherical portion 116 of the plunger 92 is permitted to move from its upward position 140 spaced from the sheet 58 as shown in phantom as 142 to its lower position with the spherical portion 116 and the guide 90 trapping and wrapping the sheet 58 therebetween as shown in solid. The plunger 92 thus moves a distance PD from its position in contact with the sheet 58 to its fully engaged position within the cavity 124. As shown in FIG. 2, the spherical portion 116 of the plunger 92 contacts the sheet 58 at contact zone 154 an arcuate distance CL defined by the included angle σ and the diameter DIA.

Ignoring the thickness of the sheet 58, the formula may be expressed by the following formula:

$$CL=DIA\times\sigma\div 360.$$

Where:

DIA=diameter of the plunger

σ=the included angle of contact, and

CL=the length of contact

The length sheet 58 prior to the stroke of the plunger 92 is equal to the chordal length CHL of the contact zone of the plunger 92 and represents the chordal length across the contact length of the sheet 58 against the plunger 92 or may be determined by the following formula:

$$CHL=DIA\times\sin(\sigma\div 2).$$

where:

DIA=diameter of the plunger

σ=the included angle of contact, and

CHL=chordal length of contact

Referring still to FIG. 2, prior to engagement of the plunger 92 against the sheet 54, the trailing edge 150 of the sheet 58 is at the first trailing edge position 152 and the leading edge 100 is at the first leading edge position 146. As the plunger 92 is engaged downwardly in the direction of arrow 94, the sheet 58 is rapped around the spherical portion 116 such that trailing edge 150 of the sheet 58 moves in the direction of arrow 62 to second trailing edge position 156.

As shown in FIG. 2, with the plunger 92 in engagement with the sheet 58, the stop 112 and the one-way gate 126 serve to prohibit movement of the leading edge 100 in the direction opposed to the arrow 62 so that the leading edge 100 remains in the first leading edge position 146. The second trailing edge position 156 is spaced from the first trailing edge position 152 a distance equal to the index length IL. The distance IL can be estimated to be the length of contact CL minus the chordal length CHL.

When the plunger 92 is returned to the unengaged position 142 as shown in phantom, the one-way gate 126 prevents the motion of the trailing edge 150 in a direction opposed to the arrow 62. The memory, beam strength or rigidity of the sheet 58 causes the sheet 58 to return into a generally planar position. The leading edge 100 thus moves in the direction of arrow 62 to permit the sheet 58 to return to its linear position. The leading edge 100 thus moves from the first leading edge position 146 to the second leading edge position 160. The first leading edge position 146 is spaced from the second leading edge position 160 a distance IL or the index length. Thus for each stroke of the plunger 92, the sheet 58 moves in the direction of arrow 62 a distance IL or an index length.

It should be appreciated by increasing the diameter DIA or the included angle of contact σ, the index length IL can be correspondingly increased.

As can readily be seen from FIG. 2, the operating direction of the indexing mechanism can be changed from the first direction 62 to the second direction 110 by simply reorienting the one-way gate 126 and the stop 112 in the opposite direction. For example, the one-way gate 126 shown in solid may be moved to position 162 and the stop 112 may be moved to position 173 as shown in phantom. The one-way gate 126 and the stop 112 may be positioned in the positions as shown in phantom by providing for two mounting locations for the gate 126 and the stop 112. Alternatively, a first positioning mechanism 158 including a notched slide and pins 170 may be utilized to move the one-way gate 126 to the second position 162 as shown in phantom and a second positioning mechanism 166 as shown in phantom may be used for moving the stop 112 to the second position 162 as shown in phantom. The indexing mechanism may for example include a first slot 167 for providing for mounting the stop 112 in first position 171 as shown as the dashed line and a second slot 169 for providing for mounting the stop 112 in second position 173 shown in phantom. By moving the gate 126 and the stop 112 to the positions 162 and 173, the indexing mechanism 80 can be utilized to advance sheets 58 in the direction of arrow 113.

By providing an indexing mechanism including a guide and urging member movable in directions skewed to substrate path, a simple inexpensive and compact indexing mechanism can be provided.

The use of a solenoid for urging the paper in a direction perpendicular to the paper path, provides an indexing mechanism which does not require large motors, electronic circuits or large mechanical linkages thereby providing an indexing mechanism which may be used where there are severe space restrictions.

The use of an urging member with an integral stop provides an indexing mechanism which accurately indexes in a first direction and which is simple, inexpensive and reliable.

The use of a one-way gate for permitting motion in a first direction and prohibiting that motion in an opposed position where the one-way gate includes a member having a free end, provides an indexing mechanism which can be easily realigning, providing a simple, inexpensive quickly reversible indexing mechanism.

The use of an indexing device in which the beam strength within a sheet paper contributes to the indexing motion, provides for a simple, inexpensive and reliable indexing device.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An indexing mechanism for advancing a substrate in a first direction, comprising:

a guide including a cavity, the guide for guiding the substrate along a substrate path; and an urging member having an end portion, the urging member movable in a direction to intersect the substrate and cause a portion of the substrate to be displaced with respect to the substrate path into at least a portion of the cavity, said urging member cooperating with said guide to displace a portion of the substrate so that an end of the substrate advances in the first direction.

2. An indexing mechanism according to claim 1, wherein said urging member is movable in a direction substantially perpendicular to the substrate path.

3. An indexing mechanism according to claim 1, further comprising a mechanism for cyclically moving said urging member, said mechanism comprising at least one of a solenoid and a pulsing device.

4. An indexing mechanism according to claim 1, further comprising a stop for permitting motion in the first direction and for prohibiting motion in a second direction opposed to the first direction, said stop being secured to said urging member and movable therewith, said stop having a length and a free end thereof contactable with the substrate for positioning the substrate between the free end of said stop and said guide, wherein said stop is adapted to permit motion in the first direction and to prohibit motion in a second direction opposed to the first direction.

5. An indexing mechanism according to claim 1, wherein said urging member comprises a plunger.

6. An indexing mechanism according to claim 5, wherein said plunger defines a portion thereof having an arcuate surface, said plunger cooperating with said guide so as to position the substrate between the guide and the arcuate surface of said plunger.

7. An indexing mechanism according to claim 6, wherein said one way gate comprise a member having a free end thereof contactable with the substrate for positioning the substrate between the free end of said stop and said guide, said member adapted to permit motion in the first direction and to prohibit motion in a second direction opposed to the first direction, said member forming an acute angle with said guide, so as to permit the substrate to deflect said member away from said guide to permit motion in the first direction.

8. An indexing mechanism according to claim 1, further comprising a one way gate for permitting motion in the first direction and for prohibiting motion in a second direction opposed to the first direction.

9. An indexing mechanism according to claim 6, further comprising a second one way gate for permitting motion in the first direction and for prohibiting motion in a second direction opposed to the first direction.

10. An indexing mechanism according to claim 1:

wherein said guide defines a planar surface thereof; and wherein said guide defines a cavity extending from the planar surface.

11. A printing machine of the type having an indexing mechanism for advancing a substrate in a first direction, comprising:

a guide including a cavity, the guide for guiding the substrate along a substrate path; and an urging member having an end portion, the urging member movable in a direction to intersect the substrate and cause a portion of the substrate to be displaced with respect to the substrate path into at least a portion of the cavity, said urging member cooperating with said guide to displace a portion of the substrate so that an end of the substrate advances in the first direction.

12. A printing machine according to claim 11, wherein said urging member is movable in a direction substantially perpendicular to the substrate path.

13. A printing machine according to claim 11, further comprising a mechanism for cyclically moving said urging member, said mechanism comprising at least one of a solenoid and a pulsing device.

14. A printing machine according to claim 11, further comprising a stop for permitting motion in the first direction and for prohibiting motion in a second direction opposed to the first direction, said stop being secured to said urging member and movable therewith, said stop having a length and a free end thereof contactable with the substrate for positioning the substrate between the free end of said stop and said guide, wherein said stop adapted to permit motion in the first direction and to prohibit motion in a second direction opposed to the first direction.

15. A printing machine according to claim 11, wherein said urging member comprises a plunger.

16. A printing machine according to claim 15, wherein said plunger defines a portion thereof having an arcuate surface, said plunger cooperating with said guide so as to position the substrate between the guide and the arcuate surface of said plunger.

17. A printing machine according to claim 16, wherein said one way gate comprise a member having a free end thereof contactable with the substrate for positioning the substrate between the free end of said stop and said guide, said member adapted to permit motion in the first direction and to prohibit motion in a second direction opposed to the first direction, said member forming an acute angle with said guide, so as to permit the substrate to deflect said member away from said guide to permit motion in the first direction.

18. A printing machine according to claim 11, further comprising a one way gate for permitting motion in the first direction and for prohibiting motion in a second direction opposed to the first direction.

19. A printing machine according to claim 18, further comprising a second one way gate for permitting motion in the first direction and for prohibiting motion in a second direction opposed to the first direction.

20. A printing machine according to claim 11:

wherein said guide defines a planar surface thereof; and wherein said guide defines said cavity extending from the planar surface.

21. A method of advancing a substrate in a printing machine comprising:

guiding the substrate along a substrate path in a first direction along a guide having a cavity;

advancing a member toward the substrate;

positioning the substrate between the member and said guide; and displacing a portion of the substrate substantially adjacent the member into the cavity of the guide so that an end of the substrate advances in a first direction along the substrate path.

22. The method of claim 21 further comprising displacing a portion of the substrate in a direction normal to the direction of the substrate path.

23. The method of claim 21 further comprising advancing said member toward the substrate in a direction skewed with respect to the substrate path.

* * * * *